United States Patent [19]

Costabile et al.

[11] 4,417,852

[45] Nov. 29, 1983

[54] MARINE PROPELLER WITH REPLACEABLE BLADE SECTIONS

[76] Inventors: John J. Costabile, 7037 E. Moreland, Scottsdale, Ariz. 85257; Arvid B. Costabile, 2716 E. Forrest Cir., Tempe, Ariz. 85281; Ernest Costabile, 2107 E. Carson Dr., Tempe, Ariz. 85282

[21] Appl. No.: 297,343

[22] Filed: Aug. 28, 1981

[51] Int. Cl.[3] ..... F03B 3/12

[52] U.S. Cl. ..... 416/2; 416/93 A; 416/134 A

[58] Field of Search ..... 416/2, 93 A, 134 R; 415/9, DIG. 3; 29/526 R, 156.8; 220/75, 76

[56] References Cited

U.S. PATENT DOCUMENTS

| | | | |
|---|---|---|---|
| 1,076,382 | 10/1913 | Maloney | 220/75 |
| 1,142,916 | 6/1915 | Scott | 416/2 |
| 1,469,045 | 9/1923 | MacMurchy | 415/9 |
| 3,790,304 | 2/1974 | Langlois | 416/93 M |
| 3,876,331 | 4/1975 | Den Herder et al. | 416/93 A |

*Primary Examiner*—Stephen Marcus
*Assistant Examiner*—Brian J. Bowman
*Attorney, Agent, or Firm*—Cahill, Sutton & Thomas

[57] ABSTRACT

A marine propeller includes a hub and a plurality of replaceable, respectively adjacently positioned blade support sections attached to the hub. The hub has a central portion and a plurality of spoke members that extend radially out from the central portion. Each of the blade support sections includes an inner lip that engages a respective one of the spoke members and an outer lip adjoining and overlapping the inner lip of an adjacent blade support section. Each pair of adjoining outer and inner lips are drawn tightly against a respective one of the spoke members by a plurality of screws. The spaces between the respective spoke members form a plurality of exhaust gas passages.

4 Claims, 7 Drawing Figures

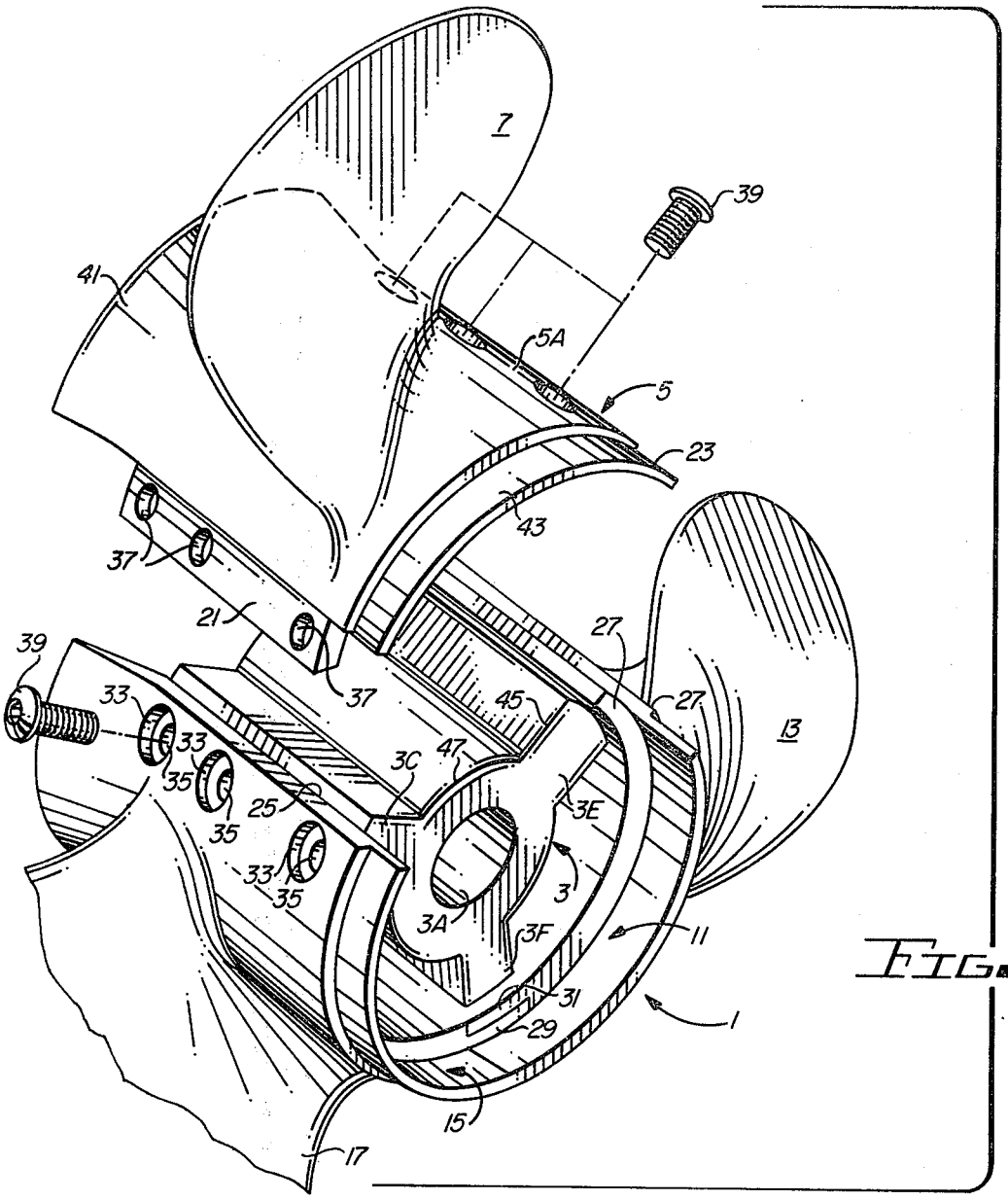
FIG. 1
FIG. 2
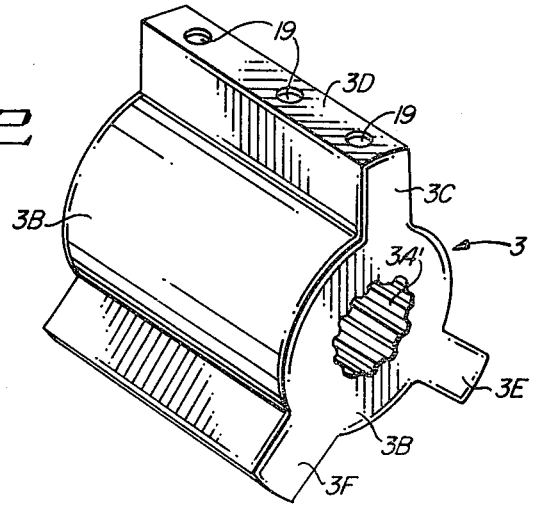

MARINE PROPELLER WITH REPLACEABLE BLADE SECTIONS

BACKGROUND OF THE INVENTION

The invention relates to marine propellers, particularly to marine propellers having a plurality of replaceable blade sections.

Although a variety of replaceable blade propeller assemblies have been proposed, including those shown in U.S. Pat. Nos. 3,764,228, 3,073,395 and 1,010,929, such multiple piece propeller assemblies have not found widespread acceptance, and single piece propellers are presently used on the vast majority of boats. Use of single piece propellers continues despite the numerous advantages that a practical, reliable, low cost piece propeller assembly with replaceable blade sections would have. For example, one piece propellers usually have to be replaced if they strike heavy, solid objects that severely bend one blade of the propeller during operation of the boat. One-piece hub and propeller assemblies are very bulky, and require a large amount of storage space in a boat. Furthermore, propeller blades of different pitches are preferable for various types of boat operation. Therefore, it would be advantageous for a boat owner to be able to easily and conveniently change blade pitches for different types of operation, such as pulling skiers or high speed cruising. Many single piece propeller assemblies include through-the-propeller exhaust systems having a plurality of passages in the central portions of the hub through which exhaust gases can excape without interferring with flow of water around the propeller blades during normal boat operation. U.S. Pat. No. 3,876,331 discloses a three-piece marine propeller assembly having removable blade sections and exhaust gas passages through the hub portion thereof. However, none of the three-piece replaceable blade propeller assemblies mentioned above have found wide-spread acceptance because of their complexity. All of them have been implemented by means of inherently flimsy mortise and tenon or collar arrangements for connecting the opposed flanges of the blade support sections to a main hub. Besides being inherently rather flimsy, the proposed devices have been unduly expensive because the main components have been required to be precisely machined to a great extent to provide close tolerance required by the type of construction required by the design of the prior replaceable blade propeller assemblies.

Despite the variety of proposed replaceable blade propeller assemblies that have been introduced, there remains a need for a low cost, highly reliable, easily replaceable multiple piece replaceable blade propeller assembly that is substantially more satisfactory to the boating public than in the device yet proposed.

Accordingly, it is an object of this invention to provide a low cost, highly durable, easily installable replaceable blade marine propeller system that is significantly less complex in design than those of the above-mentioned prior art.

Many commonly used marine propellers utilize rubber shock absorption devices in their hub assemblies to reduce shock transmitted from a propeller blade that strikes an obstacle to the drive train or motor of the heat to reduce damage thereto. Provision of such rubber shock absorbing devices adds to the complexity of its construction and expense of marine propellers, especially those having through-the-propeller exhaust passages, which are highly desirable in order to achieve efficient propeller operation and avoid cavitation under high performance operating conditions.

Accordingly, it is another object of the invention to provide a greatly simplified marine propeller that obviates the need for using rubber devices to prevent transmission of excessive shock to the drive train and motor of a boat when the propeller hits an obstruction.

SUMMARY OF THE INVENTION

Briefly described and in accordance with one embodiment thereof, the invention provides a marine propeller including a central hub for receiving a motor driven shaft, a plurality of blade support members that are rigidly but removably attached to the hub, and attaching devices for removably attaching the respective blade support members from the hub, wherein each of the blade support members has a propeller blade attached thereto, and includes an inner lip and an outer lip, the outer lip of each blade support member adjoining and overlapping the inner lip of an adjacent blade support member, the attaching devices pushing the outer lip of each blade support member tightly toward the hub, thereby so forcing the overlapped and adjoined inner lips against the hub and rigidly attaching each blade support member to the hub.

In this described embodiment of the invention, the hub includes a cylindrical central portion for receiving the motor driven shaft and three uniformly spaced spoke members extending radially outward from the cylindrical central portion. The inner lips of the respective blade support sections adjoin the respective outer end portions of the three spoke members. A plurality of cap screws extend through aligned holes in the adjoining outer and inner lips and engage threaded holes in the outer end portions of the respective spoke members. The spaces between the radial spoke members form passages for exhaust gases, which pass from the front of the propeller out the rear of the propeller during boat operation. In one described embodiment of the invention, a propeller blade is integrally formed with each of the blade support sections, and the inner and outer lips and also an outwardly flared skirt flange are also integrally formed with each blade support section. When the three blade support sections are rigidly attached to the hub, the three blade support sections form a cylindrical sleeve about the hub.

In one embodiment of the invention, the weakened portion having a groove therein is provided in the base portion of each propeller blade to provide a break-away blade that will break free of the blade support sections if that propeller blade strikes an obstacle during boat operation, thereby avoiding excessive shock from being transmitted to the drive train or motor of the boat and preventing damage thereto.

In another embodiment of the invention, each propeller blade includes separate base and main portions that have respectively adjoining and mating overlapping tongue and groove sections, and are held together by a plurality of cap screws. Propeller blades can then be removed and replaced by removing those cap screws and fastening new propeller blades onto the original bases.

BRIEF DESCRIPTION OF THE DRAWINGS

FIG. 1 is a partial exploded view of one embodiment of the invention.

FIG. 2 is a perspective view of the hub of the replaceable blade propeller of FIG. 1.

DESCRIPTION OF THE INVENTION

Figure 3:
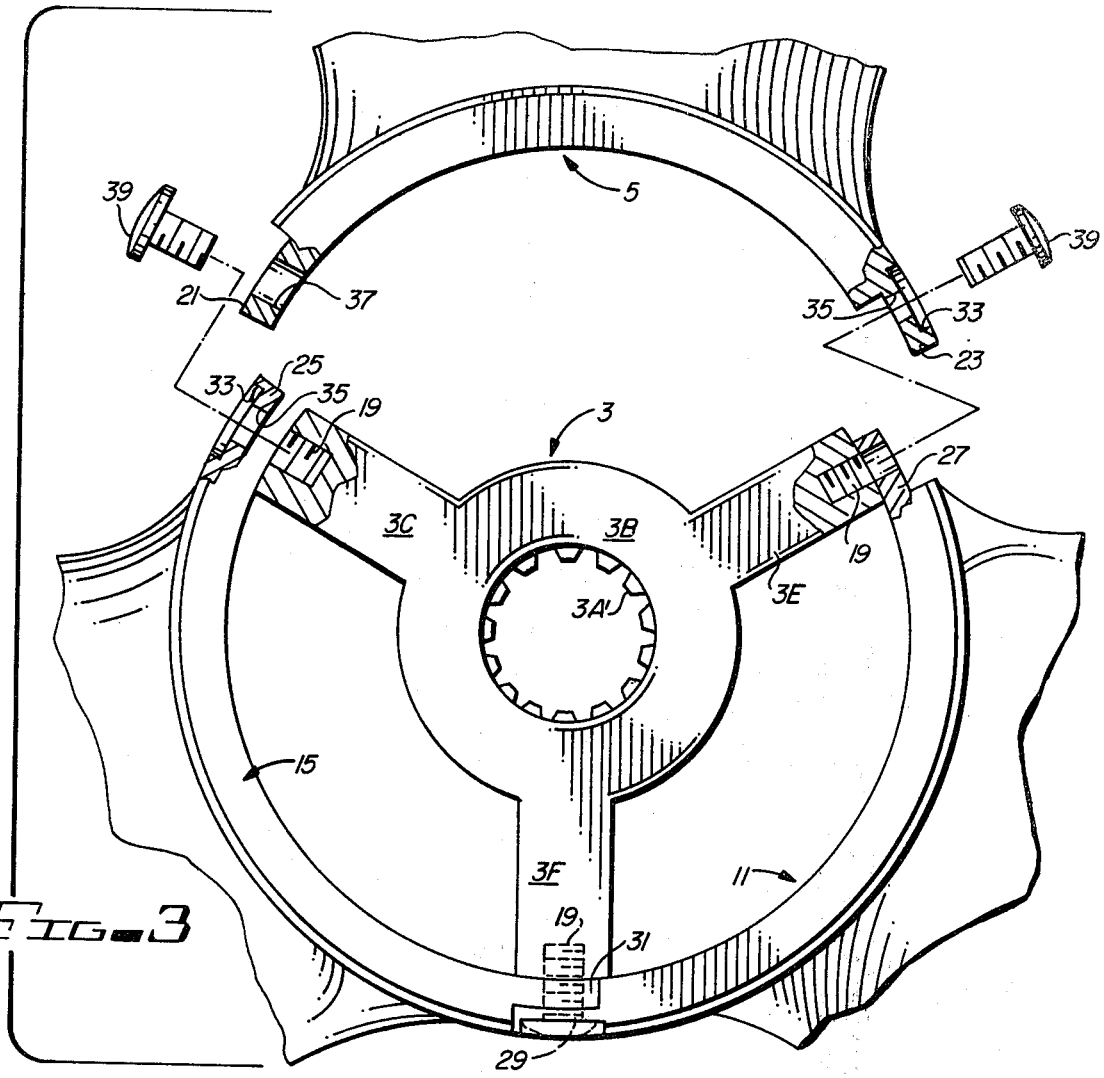
FIG. 3 is a partial sectional view of the replaceable blade propeller shown in FIG. 1.
Figure 4:
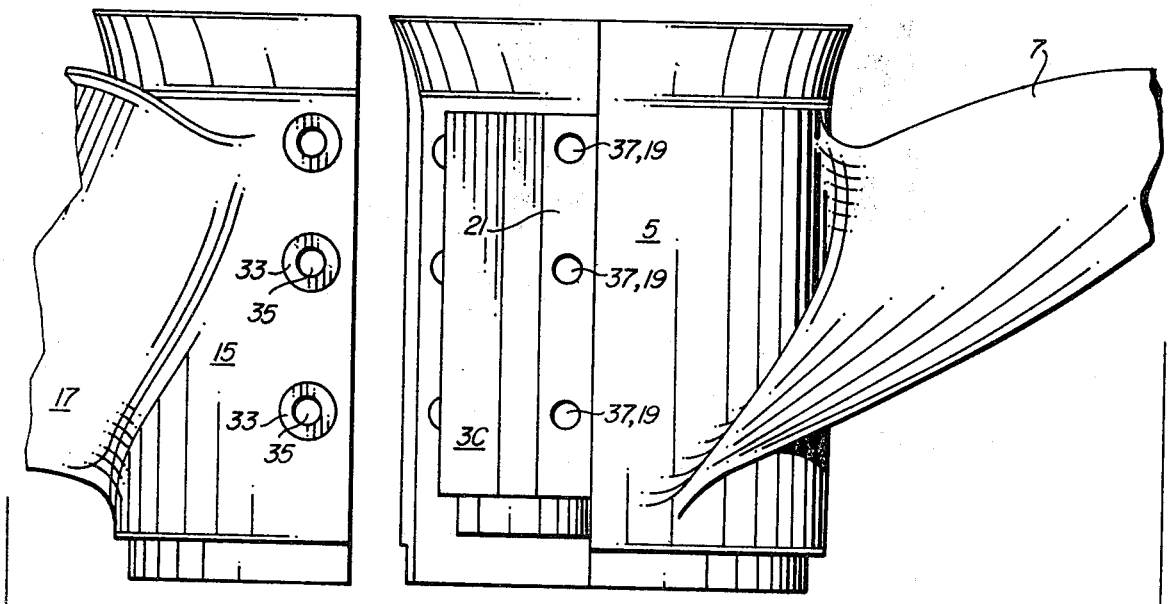
FIG. 4 is a partial top view of the propeller of FIG. 1 with one blade support section moved aside.

Referring now to the drawings, particularly FIGS. 1–4, replaceable blade propeller assembly 1 includes a hub 3 and three replaceable blade sections 5, 11 and 15 that support propeller blades 7, 13, and 17, respectively.

Referring particularly to FIGS. 1 and 2, hub 3 (which is shown reversed end to end in FIG. 2) includes a cylindrical center portion 3B having an axial hole 3A therein for receiving a motor driven shaft. The rear end of hole 3A has a plurality of spline teeth 3A′ for engaging mating teeth of a typical motor driven shaft. Three spoke members 3C, 3E, and 3F extend radially outward from cylindrical portion 3B of hub 3. Each of spoke members 3C, 3E, and 3F is integral with hub section 3B, is rectangular in configuration, and includes a rounded outer surface such as 3D having a radius of curvature that extends to the center axis of cylindrical portion 3B.

Each of replaceable blade sections 5, 11, and 15 are identical, and only blade section 5 will be described in detail.

Replaceable blade section 5 includes a blade support section 5A that has the general configuration of a third of a cylinder. Its leading edge has a shoulder 43 which, in combination with the similar shoulders of the remaining two replaceable blade sections forms a cylindrical band of reduced diameter for communicating with a recess in the housing of a typical propeller shaft for preventing excape of exhaust gases around the leading of the propeller and causing exhaust gases to flow through the passages formed by the spaces between spoke members 3C, 3E, and 3F.

The left edge of blade support section 5A includes an inner lip 21 having three holes 37 therein. The right-hand edge of blade support 5A includes an outer lip 23 having a plurality of holes 35 therein, each of holes 35 having an outer increased diameter shoulder 33 for retaining the head of a cap screw 39.

Similarly, blade support section 15 has an outer lip 25 and an inner lip 31. Blade support section 11 has an outer lip 29 and an inner lip 27.

Each outer lip adjoins and overlaps the inner lip of an adjacent one of the blade support sections. The holes 37 of each inner lip are aligned with the spaced holes 19 located across the outer surface of a respective one of the spoke members 3C, 3E, or 3F against which that lip member is adjoined. The holes 37 of each lip are also aligned with the holes 35 of the overlapping outer lip of an adjacent blade support section.

Each of cap screws 39 passes through one of holes 35 of an outer lip, an aligned hole 37 of an inner lip, and engages the threads of a hole 19 in one of spoke members 3C, 3E, or 3F. The head of each cap screw 39 is retained by the corresponding shoulder 33.

Thus, it can be seen that when all of the cap screws 39 are in place, the three replaceable blade sections 5, 11 and 15 form a continuous cylinder attached to hub 3 supporting the three propeller blades 7, 13 and 17, respectively, to provide a single marine propeller unit.

Note that the edges such as 45 and 47 of hub 3 are rounded to provide smooth and efficient flow of pressurized exhaust gases around spoke members 3C, 3E, etc. and through the above-mentioned passages to the rear of propeller 1.

Preferably, hub 3 is formed of hard, high quality stainless steel. Replaceable blade sections 7 can be unitary devices cast from suitable aluminum or aluminum alloy materials, plastic or stainless steel materials, or the like.

Figure 5:
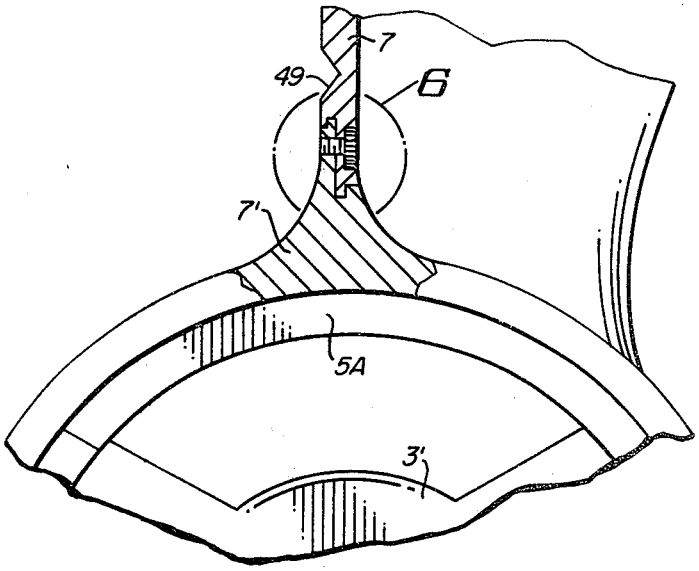
FIG. 5 is a sectional view of an alternate embodiment of the invention.

Referring now to FIG. 5, in an alternate embodiment of the invention, each of the propeller blades, such as 7, include a base portion 7′ attached to the outer surface of blade support section, such as 5A. As best shown in FIG, 6, which is an enlarged view of detail 6 of FIG. 5, base section 7′ includes a lip section 51 that has a interior narrowed upper end 51A. Upper section of blade 7 includes a groove 60 that receives narrowed portion 51A of lip 51. The upper portion of blade 7 includes a lip 55 that has a interior narrowed portion 55A that fits snugly in a slot 62 of base portion 7′. The surfaces of lips 51 and 55 are precisely flat, so that the corresponding lip and groove portions of base section 7′ and the upper portion of blade 7 fits snugly in a tongue-and-groove relationship. A hole 57 through lip section 51 and a hole 59 through lip section 55 are aligned when the upper section of blade 7 is snugly mated with base section 7′ thereof. A cap screw 61 extends through clearance hole 59 and engages threads of hole 57, and is flush with the left surface of lip 51 when cap screw 61 is tightened.

Figure 6:
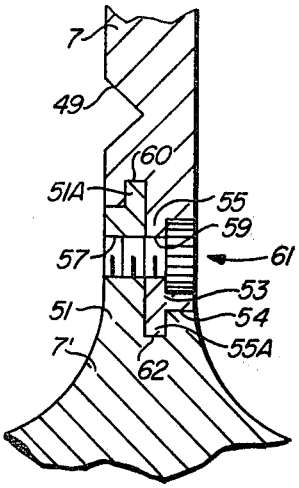
FIG. 6 is an enlarged view of detail 6 of FIG. 5.
Figure 7:
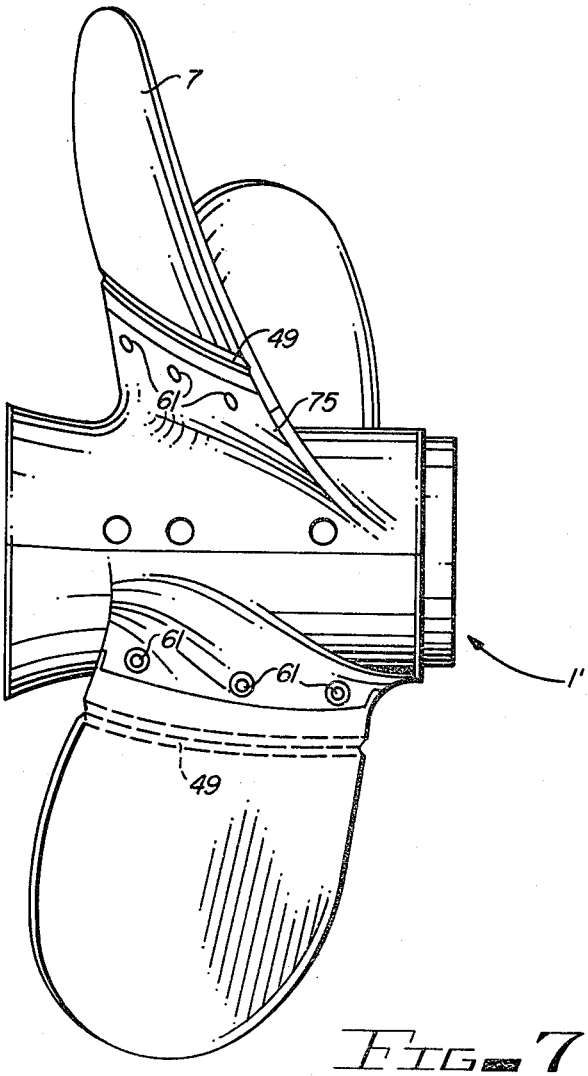
FIG. 7 is a side view of an embodiment of the invention shown in FIG. 5.

In this embodiment of the invention, a groove 49 disposed above the connecting means shown in FIG. 6 is provided along the width of each propeller blade, such as 7, as better seen in FIG. 7. This groove results in a weakened section near the base of blade 7, so that the main portion of blade 7 will break away from the base portion 7′ thereof if the main portion hits an obstruction during operation of the boat. This will prevent excessive shock from being transmitted through the propeller shaft to the drive train or motor of the boat, and thereby will prevent damage to the drive train or motor. The broken main blade section 7 can then be removed and replaced by removing the cap screws 61 and reinstalling a spare blade. Of course, different pitched blades can be easily installed.

In FIG. 7, the arrangement of FIG. 5 is shown on a conventional single piece hub and blade support section, wherein the base support sections are separately removable.

The described embodiments of the invention provide a low cost, highly rigid and durable, and greatly simplified replaceable blade marine propeller that overcomes the previously mentioned disadvantages of prior art replaceable blade marine propellers. In the embodiments of the invention shown in FIGS. 5 through 7, spare main blade portions of different pitches may be stored in a boat without requiring a significant amount of storage space. The embodiment of the invention shown in FIGS. 1–4 provides an extremely rugged arrangement that allows quick replacement of an entire blade section if one blade is damaged, or if a propeller of different pitch is required without the necessity of removing the hub from the propeller shaft. The replaceable blade sections of FIG. 1 are much more easily stored than an entire spare propeller. The cost of each of replaceable blade sections such as 5, 11, etc. is far less than the cost of a replacement single piece marine propeller of comparable performance capability.

While the invention has been described with reference to a particular embodiment thereof, those skilled in the art will be able to make various obvious modifications to the described embodiments of the invention without departing from the true spirit and scope thereof.

We claim:

1. A marine propeller comprising in combination:

a hub comprising a cylindrical central portion having a hole therein for receiving a motor-driven shaft and a plurality of uniformly spaced spoke members integral with and extending substantially radially outwardly from said central portion, each of said spoke members having an outer surface and a plurality of spaced threaded holes therein;

a plurality of substantially identical single blade units each including a blade support base and a propeller blade attached to that blade support base, each of said blade support bases including a substantially semi-cylindrical member having an inner lip located along one edge thereof with an inner surface abutting a respective one of said outer surfaces of one of said spoke members, said semi-cylindrical member also having an outer lip located along an opposite edge of that semi-cylindrical member for overlapping and abutting an outer surface of the inner lip of an adjacent one of said semi-cylindrical members, each of said inner lips and the outer lip overlapping that inner lip having therethrough a plurality of clearance holes aligned with the respective ones of said threaded holes in the outer surface of the spoke member abutting the inner surface of that inner lip; and a plurality of screws extending through respective ones of said aligned clearance holes and engaging the threads of corresponding ones of said threaded holes to tightly attach said edges of each of said blade support bases to said outer surfaces of two adjacent ones of said spoke members, respectively, said spoke members being sufficiently thick and rigid to allow said screws and said threads of said threaded holes to be large enough and strong enough to avoid being damaged when any of said propeller blades strikes a large, hard obstacle at such high speeds that that propeller blade is at least partially sheared off, whereby individual ones of said single blade units that are severely damaged as a result of encountering large, hard objects at high speeds can be repeatedly replaced because no resulting damage to said hub occurs.

2. The marine propeller of claim 1 wherein each of said blade support bases includes a front shoulder flange and a rear outwardly flared skirt flange, said front shoulders adjoining to form a circular front shoulder for mating with a drive shaft housing and said rear outwardly flared skirt flanges forming a circular, outwardly flared skirt flange for guiding exhaust gas out of said passages and clear of said propeller blades during operation of a boat to which said propeller is attached.

3. The marine propeller of claim 1 wherein each of said propeller blades is a break-away blade that includes a weak portion along a base portion of that blade to effect yielding of that blade to an obstruction struck by that blade during operation of a boat to which said marine propeller is attached in order to prevent excessive shock from being transmitted to a drive train or motor of the boat.

4. The marine propeller of claim 1 including attachment means for removably attaching said propeller blades to respective ones of said blade support bases.

* * * * *